United States Patent [19]

Kay

[11] Patent Number: 4,704,839

[45] Date of Patent: Nov. 10, 1987

[54] THERMAL BARRIER EXTRUSION

[75] Inventor: Carl J. Kay, Burbank, Calif.

[73] Assignee: Products Research & Chemical Corporation, Glendale, Calif.

[21] Appl. No.: 941,187

[22] Filed: Dec. 12, 1986

Related U.S. Application Data

[63] Continuation of Ser. No. 806,101, Dec. 6, 1985, abandoned.

[51] Int. Cl.[4] ..... E04C 3/30

[52] U.S. Cl. ..... 52/732; 52/235; 49/DIG. 1

[58] Field of Search ..... 52/235, 730, 732; 49/DIG. 1

[56] References Cited

U.S. PATENT DOCUMENTS

| | | | |
|---|---|---|---|
| 3,140,763 | 7/1964 | Edelstein | 52/235 X |
| 3,978,629 | 9/1976 | Echols, Sr. | 52/730 X |
| 4,064,653 | 12/1977 | Randall et al. | 49/DIG. 1 X |
| 4,115,972 | 9/1978 | Varlonga | 52/732 X |
| 4,314,424 | 2/1982 | Gordon et al. | 49/DIG. 1 X |
| 4,323,218 | 4/1982 | Plum | 49/DIG. 1 X |
| 4,330,919 | 5/1982 | Bischlipp et al. | 49/DIG. 1 X |
| 4,447,985 | 5/1984 | Weber et al. | 49/DIG. 1 X |
| 4,514,948 | 5/1985 | Meigs et al. | 52/730 X |
| 4,614,062 | 9/1986 | Sperr | 49/DIG. 1 X |

FOREIGN PATENT DOCUMENTS

| | | | |
|---|---|---|---|
| 1245567 | 7/1967 | Fed. Rep. of Germany | 52/732 |
| 2656335 | 6/1978 | Fed. Rep. of Germany | 52/730 |
| 2828504 | 1/1980 | Fed. Rep. of Germany | 52/730 |
| 2909425 | 9/1980 | Fed. Rep. of Germany | 52/730 |
| 132336 | 10/1979 | Japan | 52/730 |
| 614492 | 11/1979 | Switzerland | 52/730 |
| 2056520 | 3/1981 | United Kingdom | 52/235 |

*Primary Examiner*—William F. Pate, III
*Assistant Examiner*—Creighton Smith

[57] ABSTRACT

An improved thermal barrier extrusion in which a longitudinal metallic channel body has a left side and a right side which are connected together by thermally insulating material. A plurality of projections extending from the channel body sides into the thermally insulating material are provided which have cross-sectional configurations whose width increases away from the base or point of attachment to create bidirectional locking of the thermally insulating material to the channel body sides to reduce longitudinal shrinkage of the insulation material and increase resistance of the thermal barrier to fracture damage.

15 Claims, 13 Drawing Figures

THERMAL BARRIER EXTRUSION

This application is a continuation of application Ser. No. 806,101, filed Dec. 6, 1985, now abandoned.

BACKGROUND OF THE INVENTION

The present invention relates to thermal barriers. More particularly, the present invention relates to thermal barrier extrusions utilized in providing insulated frames for doors and windows.

At the present time, almost half of the aluminum windows and doors sold in the United States utilize thermal barrier extrusions. Thermal barrier extrusions are typically aluminum extrusions used to make the various parts of windows and doors such as the sash, sill, threshold, and jamb. In addition they are used to make the frames for mounting window, spandrel, and door units. The thermal barrier extrusion generally provides a longitudinal channel body which defines a longitudinal U-shaped cavity into which is placed an insulating material, such as polyurethane or epoxy resin, to provide a thermal barrier for thermal isolation of the mounting.

The most common method for preparing thermal barriers involves pouring a fast setting polyurethane liquid casting compound into the U-shaped cavity of the extrusion. When the compound has hardened, the bottom of the thermal barrier extrusion is cut away or otherwise removed. Removal of the bottom of the thermal barrier extrusion results in a thermal barrier having two aluminum halves joined together by the polyurethane or other thermally insulating material. No longer is there a metallic, heat conducting bridge between the two halves. Rather, the two halves are separated by the polyurethane or other thermally insulating material. The thermally insulating material serves as both a thermal insulator and additionally as a connective element.

In spite of their popularity and obvious energysaving characteristics thermal barriers suffer from two major drawbacks or deficiencies. First, repeated temperature cycling of thermal barriers leads to longitudinal, end-to-end shrinkage of the thermally insulating material within the U-shaped cavity of the aluminum thermal barrier extrusion. The shrinkage results in the formation of gaps at the ends of the window or door frame extrusion. These gaps can cause water or air leakage into the building with subsequent damage or energy loss. Shrinkage of the thermally insulating material occurs due to a complicated process which is not completely understood. However, there is reason to believe that the problem is caused mainly by the large difference in coefficients of thermal expansion between aluminum and the thermally insulating material, such as polyurethane. For example, aluminum has a coefficient of thermal expansion of $1.3\times10^{-5}$ per degree Fahrenheit while that of polyurethane ranges from 5 to $7\times10^{-5}$ per degree Fahrenheit, depending on composition. With changes in temperature the polyurethane or other thermally insulating material typically expands or contracts more than the surrounding aluminum. This differential expansion and contraction of the thermally insulating material ultimately leads to shrinkage of the thermally insulating material relative to the extrusion. Since all thermal barriers are composite structures, they are inherently susceptible to this shrinkage problem. An effective solution to the problem is highly desirable.

A second problem experienced with some thermal barriers is insufficient impact strength. Aluminum and other metallic extrusions are relatively ductile materials which are relatively resistant to impact. Polyurethane resin and other typical thermally insulating materials are relatively brittle. As a result, the thermal insulation portion of the thermal barrier often splits and cracks when the thermal barrier is dropped, cut, sawed or run through a punch press. In addition, finished window and door assemblies may break during installation if not handled carefully. The splitting or cracking of the thermally insulating material is extremely undesirable since the material is not only functioning as insulation, but is additionally a connective element which holds the two aluminum halves of the extrusion together.

It is presently desirable to provide thermal barrier extrusions in which the thermally insulating material is mechanically bound or otherwise secured within the extrusion cavity to prevent or reduce longitudinal shrinkage of the thermally insulating material. Further, it would be desirable to provide thermal barrier extrusions in which the tendency of the thermally insulating material to split, crack or otherwise fracture is reduced.

SUMMARY OF THE INVENTION

In accordance with the present invention, an improved thermal barrier is provided in which shrinkage of the thermally insulating material relative to the metal extrusion is substantially reduced and in which the resistance of the thermally insulating material to fracturing is also increased.

The present invention is based upon a thermal barrier which comprises a longitudinal channel body or extrusion having a left side, a right side, a bottom extrnding between the two sides and an open top. The channel body defines a longitudinal thermal barrier cavity into which thermally insulating material is introduced. As a feature of the present invention, a plurality of projections are provided which extend from the channel body into the thermal barrier cavity. The projections have cross-sectional configurations whose width increases beyond the point of attachment of the projection to the cavity wall. In all the prior art the width of the projections is constant or diminishing beyond the point of attachment to the cavity wall. Examples of the prior art include projections whose cross-sectional configuration or shape is semi-circular, square, rectangular, or triangular where the base and not the apex is the point of attachment to the cavity wall.

In ways well known to those skilled in the art, the projections typified by the prior art secure the separate portions of the aluminum extrusion to the thermally insulating material to prevent transverse and rotational movement. However, the prior art projection configurations are essentially uniaxial, acting along the X or horizontal axis. No provisions are made to prevent movement of the thermally insulating material along the Y or vertical axis. We have found if contraction along the Y axis as a result of low temperature is not prevented, then longitudinal end-to-end shrinkage of the thermally insulating material within the channel body cavity occurs.

Quite unexpectedly it was found that projections of a certain characteristic cross section or shape dramatically reduce or prevent longitudinal end-to-end shrinkage of the thermally insulating material within the cavity caused by temperature cycling. Projections whose cross section or shape includes an increase in width away from the point of attachment to the cavity wall prevent not only transverse and rotational movement of the aluminum sections as in the prior art, but prevent or substantially reduce the previously described shrinkage.

As a particular feature of the present invention, the projections may include a neck portion attached at one end to the channel body and a head portion attached to the other end of the neck. By providing projections in which the width of the neck portion is less than the width of the head portion, the tendency of the thermally insulating material to contract at low temperatures more than the surrounding aluminum is prevented. In other words, because the projections act bidirectionally to resist movement of the thermally insulating material along both the X (horizontal) and Y (vertical) axis of the extrusion, movement along the Z (longitudinal) axis is also resisted to a remarkable and unexpected degree.

As will be discussed in detail below the projections in accordance with the present invention provide another amazing and surprising benefit, namely, tremendous increases in the impact resistance of the finished thermal barriers. With the present invention the resistance to fracturing the thermally insulating material during manufacture and installation is greatly reduced.

DETAILED DESCRIPTION OF THE INVENTION

Figure 1:
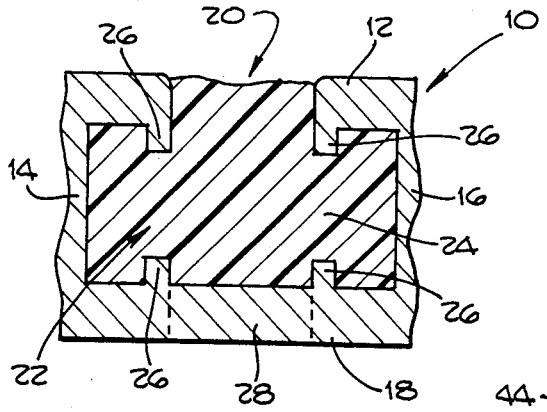
Fig. 1. PRIOR ART
FIG. 1 is a cross-sectional view of a prior art thermal barrier extrusion having square projections and a flat bottom.

A partial sectional view of a prior art thermal barrier is shown generally at 10 in FIG. 1. The thermal barrier 10 includes a longitudinal channel body 12 having a left side 14, a right side 16, a bottom 18, and an open top 20. The channel body 12 defines a longitudinal thermal barrier cavity 22 which is filled with thermally insulating material 24. The channel body 12 includes four longitudinal projections 26 which extend from the channel body into the thermal barrier cavity. The ends of ridges 26 have a square cross sectional shape. The bottom 18 of channel body 12 includes a central portion 28 (shown between the vertical phantom lines) which is removed from the channel body 12 to provide the finished thermal barrier in which the right and left halves of the channel body are connected together only by the thermally insulating material 24.

Figure 2:
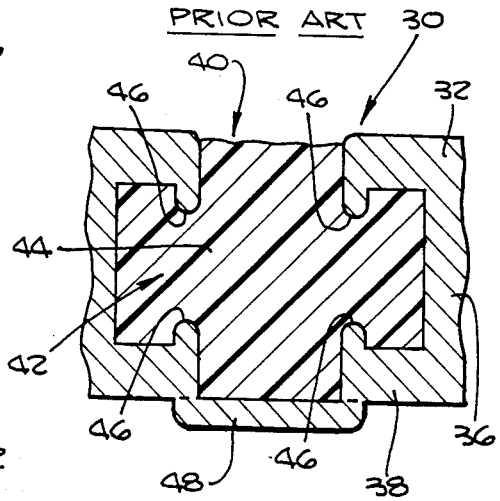
Fig. 2. PRIOR ART
FIG. 2 is a cross-sectional view of a prior art thermal barrier extrusion having rounded projections and a recessed bottom.

A second prior art thermal barrier is shown generally at 30 in FIG. 2. The thermal barrier 30 includes a channel body 32 having a left side 34, a right side 36, a bottom 38 and an open top 40. The body 32 defines a thermal barrier cavity 42 which is filled with thermally insulating material 44. The channel body 32 includes four projections 46 which extend into the cavity 42. The projections 46 are basically the same as the projections 26 shown in FIG. 1 except that the ends of the ridges 46 are rounded. The channel body 32 includes a recessed bottom portion 48 (bounded on each end by horizontal phantom lines) which is removed to provide the finished thermal barrier in which the two channel body sides are connected together by the thermally insulating material 44.

Figure 3:
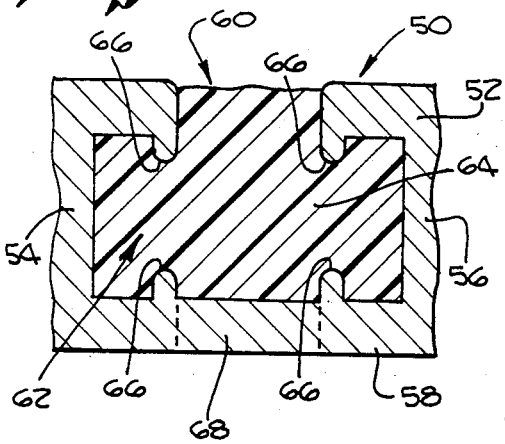
Fig. 3. PRIOR ART
FIG. 3 is a cross-sectional view of a prior art thermal barrier extrusion having rounded projections and a flat bottom.

A third exemplary prior art thermal barrier is shown generally at 50 in FIG. 3. The thermal barrier 50 includes a channel body 52 having a left side 54, a right side 56, a bottom 58 and an open top 60. The channel body 52 defines a thermal barrier cavity 62 which is filled with thermally insulating material 64. The channel body 52 includes projections 66 which extend inward into the cavity 62. The projections 66 are the same as the projections 46 shown in FIG. 2. The channel body 52 also includes a flat central portion 68 (shown between vertical phantom lines) which is removed to provide the finished thermal barrier in which the two channel body sides are connected together by the thermally insulating material 64.

Figure 4:
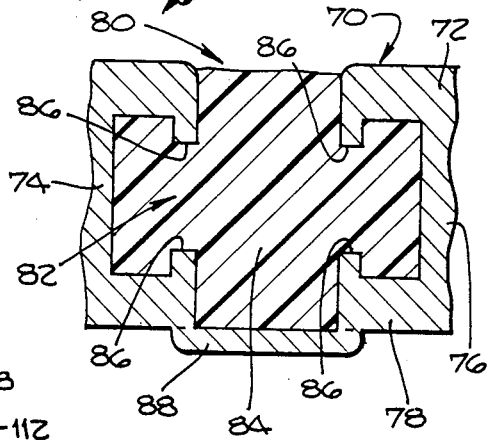
Fig. 4. PRIOR ART
FIG. 4 is a cross-sectional view of a prior art thermal barrier extrusion having square projections and a recessed bottom.

A fourth exemplary prior art thermal barrier is shown generally at 70 in FIG. 4. The thermal barrier 70 includes a channel body 72 having a left side 74, a right side 76, a bottom 78, and an open top 80. The channel body 72 defines a thermal barrier cavity 82 which is filled with thermally insulating material 84. The channel body 72 includes projections 86 which extend into the cavity 82. The projections 86 are the same as the projections 26 shown in FIG. 1. The channel body 72 also includes a recessed bottom portion 88 which is similar in design to the bottom portion 48 shown in FIG. 2. The bottom portion 88 is also designed to be removed to provide the finished thermal barrier in which the right and left sides of the channel body are connected together by the thermally insulating material 84.

Figure 6:
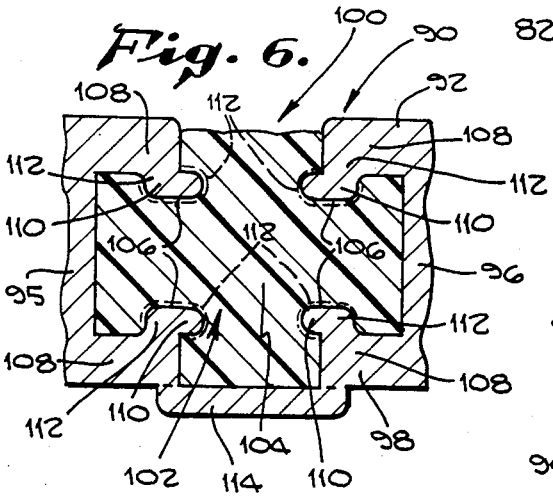
FIG. 6 is a detailed sectional view of the channel body shown in FIG. 5 wherein the thermal barrier cavity is filled with thermally insulating material.
Figure 5:
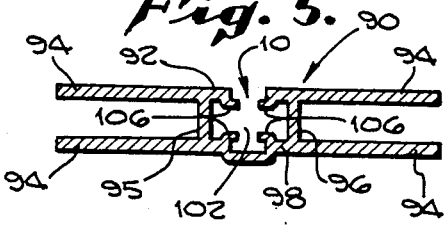
FIG. 5 is a cross-sectional view of an exemplary longitudinal channel body in accordance with the present invention in which the thermal barrier cavity is empty.

A first exemplary thermal barrier in accordance with the present invention is shown generally at 90 in FIGS. 5 and 6. The thermal barrier 90 included a longitudinal channel body 92 which includes horizontal frame members 94 as shown in FIG. 5. The frame members 94 do not form any part of the invention and are included as showing exemplary structures which are includes as part of the overall door or window frame. The channel body 92 includes a left side 95, right side 96, bottom 98 and an open top 100. The channel body 92 defines a thermal barrier cavity 102 which is filled with thermally insulating material 104 (see FIG. 6).

The channel body 92 includes four projections 106. The projections 106 each includes a head portion 110 which is connected directly to the horizontal portions 108 of the channel body. As can be seen from FIG. 6, the width as indicated in phantom at 112 of the projection 106 increases beyond the point of attachment of the projection 106 to the channel body 92.

As previously mentioned it was discovered in accordance with the present invention that projections whose width increases beyond the point of attachment create bidirectional locking of the thermally insulating material within the channel body. This bidirectional locking prevents movement during temperature cycling not only in the X (horizontal) axis, but in the Y (vertical) axis as well. When movement in the Y and X axes is restrained or prevented, movement in the Z (longitudinal) axis is also prevented to a surprising degree. In general, projections whose width increases beyond the point of attachment to the channel body can be further described as having a neck attached to the channel body and a head which is wider than and is attached to the neck.

The channel body 92 includes a central bottom portion 114 which is similar to the bottom portions 48 and 88 shown in FIGS. 2 and 4. Bottom portion 114 is also designed to be removed to provide a finished thermal barrier having two U-shaped channel body sides 95 and 96 connected together by the thermal insulating material 104.

Figure 7:
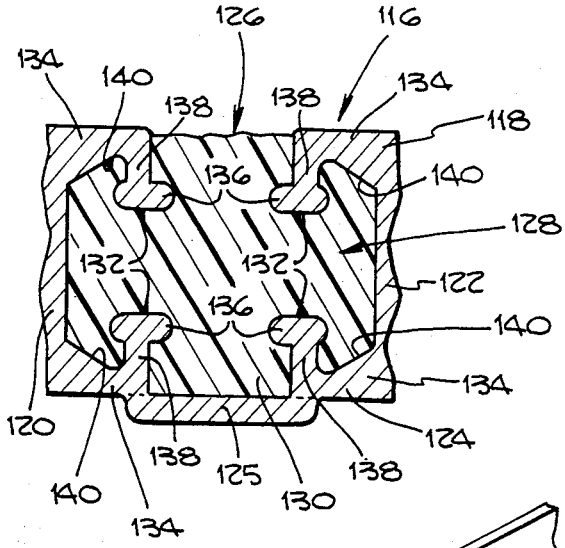
FIG. 7 is a cross-sectional view of a second exemplary thermal barrier extrusion in accordance with the present invention.

A second exemplary embodiment is shown generally at 116 in FIG. 7. The second embodiment includes a longitudinal channel body 118 which includes a left side 120, right side 122, bottom 124, and open top 126. The channel body 118 defines a thermal barrier cavity 128 which is filled with thermally insulating material 130. The channel body 118 includes projections 132. The projections 132 each include a head portion 136 and a neck portion 138 located between the horizontal side portion 134 of the channel body 118 and head portion 136. The embodiment shown in FIG. 7 is basically the same as the embodiment shown in FIG. 6 except that the interior side 140 of the horizontal portion 134 is sloped inward to produce a clearly defined neck portion 138. The head portion 136 may be characterized as having an oval shaped cross section including a middle portion and rounded edges located on each side of the middle portion. The oval shaped head 136 is connected to the neck 138 at the middle portion of the head.

The extrusion bottom 124 also includes a central bottom portion 125 which is removed to provide the final thermal barrier having two channel body sides connected together by the thermally insulating material 130.

Thermal cycling tests were conducted to determine the percent of shrinkage of various thermally insulating materials when placed within the various channel bodies shown in FIGS. 1–7. The thermally insulating materials tested were polyurethane resins available commercially and referred to as Product A, Product B, Product C, Product D and Product E. Product A and Product B are medium strength, fast curing polyurethane materials. Product C is a high strength, heat resistant polyurethane material. Product D is a low strength, low heat resistant polyurethane material and Product E is a high strength, high heat resistant polyurethane material.

Aluminum extrusions having the six different cavity designs set forth in FIGS. 1–7 were fileld with each of the above five polyurethane materials and cured according to conventional procedures. Three specimens of each fileld thermal barrier extrusion were then subjected to twenty temperature cycles. The temperature cycles were as follows: 4 hours at −40° F. followed by 1 hour at 75° F. followed by 4 hours at 180° F. followed by 15 hours at 75° F. to thereby provide a total time of 24 hours for each cycle.

The results of the shrinkage testing are summarized in Table 1. As the results show, the extrusion designs in accordance with the present invention (FIGS. 5–7) provide reduced polyurethane shrinkage for those materials which exhibited shrinkage in the prior art cavity designs shown in FIGS. 1–4.

TABLE 1

AVERAGE PERCENT SHRINKAGE OF POLYURETHANE MATERIALS IN EXTRUSION DESIGNS AFTER TEMPERATURE CYCLING

| Design | Product A | Product B | Product C | Product D | Product E |
|---|---|---|---|---|---|
| FIG. 1 | 2.1% | 2.5% | 2.0% | 1.6% | 2.2% |
| FIG. 2 | 2.0% | 2.4% | 1.8% | 1.3% | 2.0% |
| FIG. 3 | 2.3% | 2.5% | 2.1% | 1.7% | 2.0% |
| FIG. 4 | 1.8% | 1.9% | 1.6% | 1.2% | 1.8% |
| FIGS. 5–6 | 0% | 0% | 0% | 0% | 0% |
| FIG. 7 | 0% | 0% | 0% | 0% | 0% |

The cavity design shown in FIGS. 6 and 7 was further tested under contaminated surface conditions which promote thermal insulation shrinkage. In these tests, three different thermally insulating materials (Product A, Product C, Product E) were used. Prior to filling the extrusion with insulating material, the extrusion was dipped in a 1% by weight solution of Cerechlor S-45 chlorinated paraffin (available from Diamond Shamrock Co.) in methyl ethyl ketone and the solvent allowed to flash off. In one instance a ten % by weight solution of Cerechlor S-45 in methyl ethyl ketone was used. The oily residue on the surface of the extrusion prior to filling was quite perceptible for the 1% solutions. The 10% solution dip left the extrusion sticky to the touch. The chlorinated paraffin was deliberately chosen for contaminating the extrusion to promote insulating material shrinkage since it is a common ingredient in extrusion die lubricants. Three samples for each insulation material/contaminated extrusion combination were tested by subjecting them to twenty thermal cycles as described above. No shrinkage of any of the materials was detected including the extrusion which was contaminated with the 10% Cerechlor S-45 solution.

Impact testing of four of the above listed insulation materials (Product B, Product C, Product D and Product E) was conducted on the extrusion cavity designs shown in FIGS. 1–7. The impact testing was designed to measure resistance to breakage of the thermally insulating material along the longitudinal axis of the finished extrusion where the bottom portions (28, 48, 68, 88, 114 and 125) have been removed. Three inch lengths of the finished extrusions were fixed along one side and an impact point was located two inches away from the fixed side of the extrusion which was on the other side of the insulating material. This provided a two inch moment arm for the impact tests.

The results of the impact tests are shown in Table II. The values are given in foot-pounds per three inch extrusion length at 77° F. and are an average of ten determinations.

TABLE II

IMPACT STRENGTH AS A FUNCTION OF DESIGN

| Design No. | Product B | Product C | Product D | Product E |
|---|---|---|---|---|
| FIG. 1 | 3.52 ± 0.46 | 1.24 ± 0.21 | 1.81 ± 0.12 | 1.74 ± 0.20 |
| FIG. 2 | 27.61 ± 4.66, 13.75 ± 2.74 | 3.79 ± 1.15 | 4.08 ± 0.90 | 2.05 ± 0.39 |
| FIG. 3 | 4.25 ± 0.44 | 1.45 ± 0.19 | 2.63 ± 0.08 | 1.84 ± 0.36 |
| FIG. 4 | 19.68 ± 2.54, 13.28 ± 2.72 | 3.64 ± 0.86 | 4.14 ± 0.72 | 2.51 ± 0.44 |
| FIG. 5–6 | 28.15 ± 6.40, 13.31 ± 3.01 | 10.32 ± 0.88, 6.33 ± 1.21 | 16.11 ± 1.55, 10.97 ± 0.83 | 5.03 ± 0.80 |
| FIG. 7 | 17.42 ± 2.71, 11.24 ± 2.78 | 8.99 ± 1.90, 6.10 ± 0.76 | 12.77 ± 2.12, 8.01 ± 1.01 | 6.13 ± 0.61 |

As can be seen from the test results shown in Table II, the extrusion designs (FIGS. 5–7) in accordance with the present invention provide consistent increases in the resistance of the thermally insulating materials to breakage along the longitudinal axis extending between the two aluminum extrusion halves.

Figure 8:
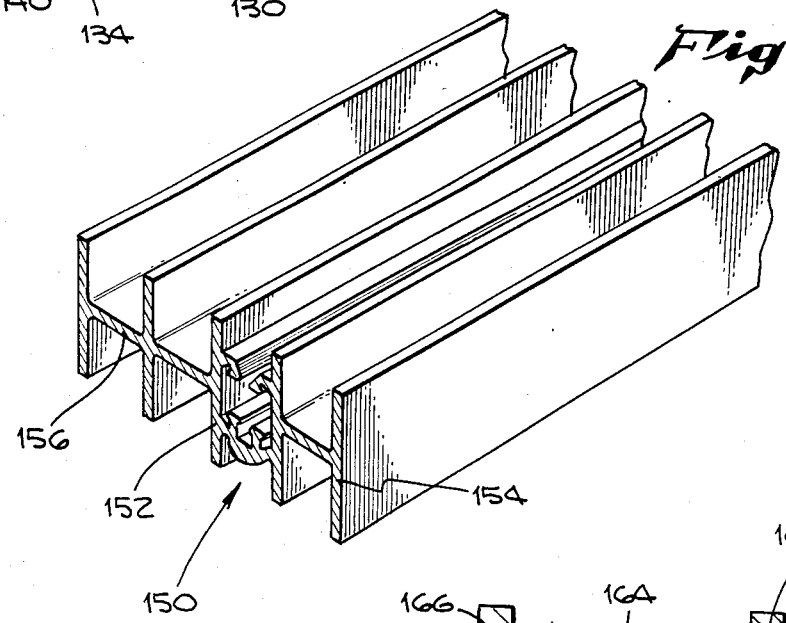
FIG. 8 is a perspective view of a third exemplary longitudinal channel body and associated frame members prior to filling of the thermal barrier cavity with thermally insulating material.

A third exemplary embodiment in accordance with the present invention is shown generally at 150 in FIGS. 8–11. This embodiment includes a longitudinal channel body 152. As shown in FIG. 8, the channel body 152 is attached to and supported by auxiliary fin structures 154 and 156. These fin structures are typically aluminum extrusions which are extruded along with the longitudinal channel body 152 to provide additional frame structure for mounting into the door or window opening. The auxiliary fin structures 154 and 156 do not form a part of the invention and are included for illustrative purposes only.

Figure 9:
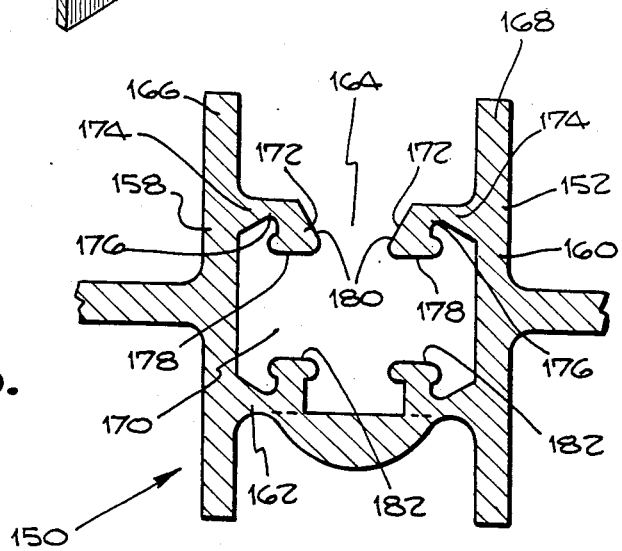
FIG. 9 is a detailed sectional view of FIG. 8 showing the channel body.

Referring to FIG. 9, the channel body 152 includes a left side 158, a right side 160, a bottom 162, and an open top 164. The sides 158 and 160 extend upward as at 166 and 168, respectively, to provide a channel or window mounting flange means into which a window pane or other structure is seated. The channel body 152 defines a thermal barrier cavity 170 into which thermally insulating material is introduced. The channel body 152 further includes upper projections 172. The upper projections 172 each includes a neck portion 176 which is attached to horizontal portion 174 of the channel body and head portin 178. The projections 172 are basically the same as the projections 132 shown in FIG. 7 except that the projections 172 each includes an outwardly extending surface 180 along the neck portion 176. The outwardly extending surface 180 increases the width of the neck portion 176 and also modifies the oval shape of the head 178 to provide the cross-sectional design shown in FIG. 9.

The channel body 152 includes lower projections 182. The lower projections 182 are the same as the projections 132 shown in FIG. 7. If desired, the upper and lower channel projections 172 and 182 may be reversed. Also, a structure in which all of the projections have the cross-sectional configuration of projections 172 is possible in accordance with the present invention.

Figure 10:
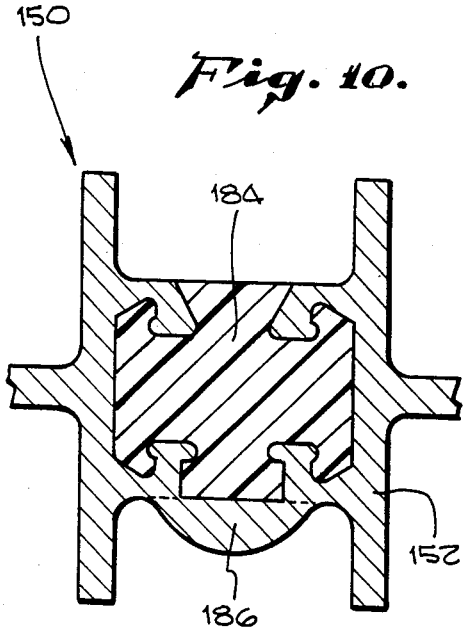
FIG. 10 is the same as FIG. 9 except that the thermal barrier cavity has been filled with thermally insulating material.
Figure 11:
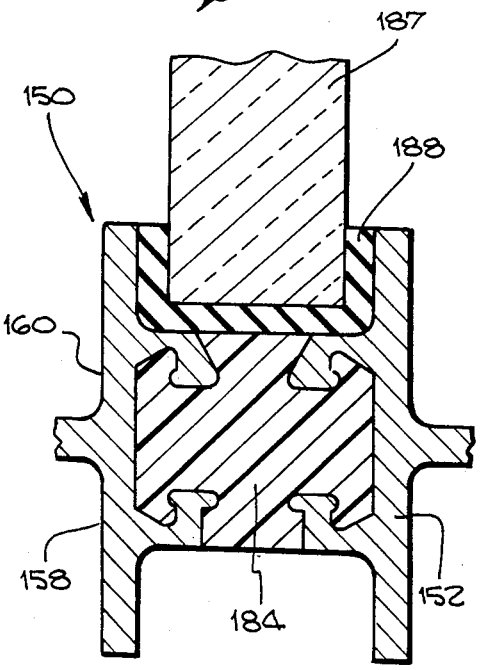
FIG. 11 shows the final thermal barrier in which the middle bottom portion of the channel body has been removed and a window pane has been mounted in place.

FIG. 10 shows the channel body 152 after it has been filled with thermally insulating material 184. After the thermally insulating material 184 has cured, the central bottom portion 186 is removed to provide the finished thermal barrier shown in FIG. 11. In the finished thermal barrier, the thermally insulating material 184 provides thermal insulation between the remaining left side 158 and right side 160 of the channel body 152. As further shown in FIG. 11, a window 187 is mounted within the channel body 152 utilizing a suitable sealant material 188 which is well known in the art.

Figure 12:
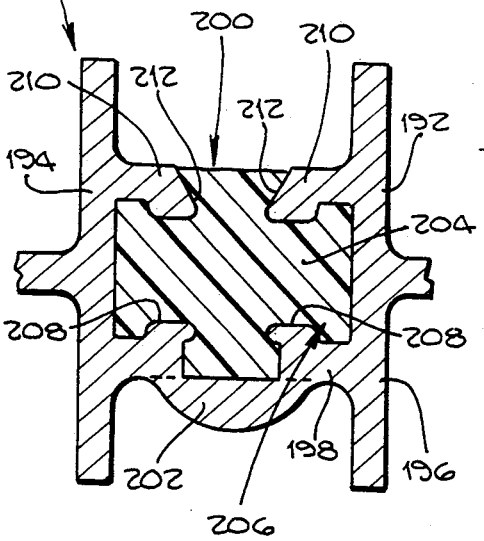
FIG. 12 is a cross-sectional view of a fourth exemplary thermal barrier extrusion in accordance with the present invention.

A fourth exemplary thermal barrier extrusion is shown generally at 190 in FIG. 12. The fourth exemplary thermal barrier 190 includes a channel body 192 having a left side 194, a right side 196, a bottom 198 and an open top 200. The central bottom middle portion 202 which is bounded by horizontal phantom lines is designed to be removed after the thermally insulating material 204 has been poured into the thermal barrier cavity 206 and cured. As with the other embodiments, removal of the middle bottom portion 202 provides the finished thermal barrier wherein the left side 194 and right side 196 of the channel body 192 are separated by the thermally insulating material 204. The channel body 192 includes lower projections 208. The lower projections 208 are basically the same as the projections 106 shown in FIG. 6. The channel body 192 further includes upper projections 210. The upper projections 210 are similar to the lower projections 208, except that outer surface 212 is provided to produce a modified head portion where the oval shape of the head portion is modified as shown in FIG. 12.

Figure 13:
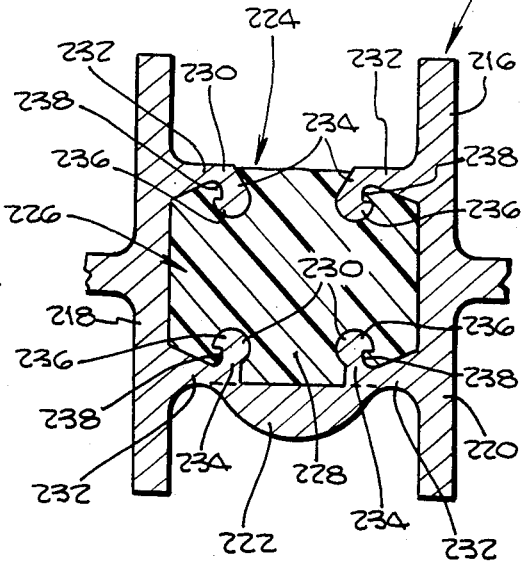
FIG. 13 is a cross-sectional view of a fifth exemplary thermal barrier in accordance with the present invention.

A fifth exemplary thermal barrier extrusion is shown generally at 214 in FIG. 13. The barrier 214 includes a channel body 216 having a left side 218, right side 220, bottom 222 and open top 224. The channel body 216 defines a thermal barrier cavity 226 into which thermally insulating material 228 is introduced. The channel body 216 is basically the same as the channel body 192 shown in FIG. 12 except that different projections 230 are provided.

The projections 230 each includes a neck portion 234 which is connected to horizontal portion 232 of the channel body and head portion 236. The head portion 236 has a circular cross section and includes a notched portion 238 adjacent to the neck portion 234 and located on the side of the head 236 closest to the channel body side. The projection 230 configuration shown in FIG. 13 is particularly preferred because the notch 238 provides an added grippng channel for mechanically locking the thermally insulating material 228 within the thermal barrier cavity 226.

In addition to the polyurethane materials previously listed, any of the other known polyurethane resins or foams may be utilized so long as they provide the desired thermal insulation. In addition, other thermally insulating materials such as eopxy resins may be utilized. The channel body is preferably made from a metal or metal alloy. Aluminum and aluminum alloys are the preferred channel body or extrusion material. Any of the metals known and commonly used to prepare thermal barrier extrusions are suitable for use in accordance with the present invention.

Having thus described exemplary embodiments of the present invention, it should be noted by those skilled in the art that the within disclosures are exemplary only and that various other alternatives, adaptations and modifications may be made within the scope of the present invention. Thus, by way of example and not of limitation, if desired, a channel body can be made in which more than four channel projections are utilized and in which each of the projections has a different cross-sectional configuration. Accordingly, the present invention is not limited to the specific embodiments as illustrated herein, but is only limited by the following claims.

What is claimed is:

1. A composite structure adapted for use as a thermal barrier comprising:

a metallic channel body having a C-shaped left side, a C-shaped right side facing said left side, an open bottom extending between the two sides and an open top defining a longitudinal thermal barrier cavity, wherein said C-shaped sides each includes horizontal top and bottom portions and a vertical side portion extending therebetween;

a solid, void free thermally insulating material located in said thermal barrier cavity in an amount sufficient to substantially fill said thermal barrier cavity and wherein said thermally insulating material contracts over a period of time more than said channel body thereby resulting in longitudinal shrinkage of said thermally insulating material relative to said channel body and wherein said insulating material is susceptible to impact fracture to allow separation of said channel body left side and right side;

a plurality of projections attached to said channel body and extending vertically into said thermally insulating material from each of said horizontal top and bottom portions of said C-shaped sides, said projections having a cross-sectional configuration whose width increases away from the point of attachment to thereby provide bidirectional locking of the thermally insulating material within the channel body to reduce longitudinal shrinkage of said thermally insulating material relative to said channel body and increase the resistance of said channel body to separation of said right and left sides by fracture of said thermally insulating material.

2. An apparatus according to claim 1 wherein said projections include a neck portion attached to said channel body and a head portion, said neck portion being located between said channel body and head portion, wherein the width of said neck portion is less than the width of said head portion.

3. An apparatus according to claim 2 wherein said head portion has an oval cross section including a middle portion and a rounded edge located on each side of said middle portion, said head being connected to said neck at the middle portion of said head.

4. An apparatus according to claim 2 wherein said head portion has a circular cross section and includes a notched portion adjacent to said neck portion and located on the side of said head portion closest to the channel body side to provide a gripping channel for mechanically locking said thermally insulating material within said thermal barrier cavity.

5. An apparatus according to claim 1 wherein said thermally insulating material is epoxy resin or polyurethane.

6. An apparatus according to claim 2 wherein said channel body is a metal.

7. An apparatus according to claim 6 wherein said channel body is aluminum or an aluminum alloy.

8. An apparatus according to claim 2 further including window mounting flange means extending upward from the side walls of said channel body at the top thereof for mounting a window or spandrel pane to said channel body.

9. An apparatus according to claim 8 further including a window or spandrel pane mounted between said window mounting flange means.

10. An apparatus according to claim 1 wherein said bottom central portion has been removed.

11. In a composite structure adapted for use as a thermal barrier wherein said apparatus includes a longitudinal channel body having a C-shaped left side,a C-shaped right side facing said left side, an open bottom extending between the two sides and an open top, said C-shaped sides each including horizontal top and bottom portions and a vertical side portion extending therebetween, said channel body defining a longitudinal thermal barrier cavity which is filled with thermally insulating material which contracts over a period of time more than said channel body thereby resulting in longitudinal shrinkage of said thermally insulating material relative to said channel body, said apparatus further including a plurality of projections extending vertically into said thermally insulating material from each of said horizontal top and bottom portions of said C-shaped sides, wherein the improvement comprises:

shaping said projections so that they each have a cross-sectional configuration whose width increases away from the point of attachment to said C-shaped sides to thereby provide bidirectional locking of the thermally insulating material within the channel body to reduce longitudinal shrinkage of said thermally insulating material relative to said channel body and increase the resistance of said channel body to separation of said right and left sides by fracture of said thermally insulating material.

12. An apparatus according to claim 11 wherein said projections include a neck portion attached to said channel body and a head portion, said neck portion being located between said channel body and head portion, wherein the width of said neck portion is less than the width of said head portion.

13. An improved apparatus according to claim 12 wherein said head portion has an oval cross section including a central portion and a rounded edge located on each side of said middle portion, said head being connected to said neck at the middle portion of said head.

14. An improved apparatus according to claim 12 wherein said head portion has a circular cross section and includes a notched portion adjacent to said neck portion and located on the side of said head portion closest to the channel body side to provide a gripping channel for enhanced bidirectional locking of said thermally insulating material within said thermal barrier cavity.

15. An improved apparatus according to claim 12 wherein said thermally insulating material is an epoxy resin or polyurethane.

* * * * *

UNITED STATES PATENT AND TRADEMARK OFFICE

CERTIFICATE OF CORRECTION

PATENT NO. : 4,704,839

DATED : November 10, 1987

INVENTOR(S) : Carl J. Kay

It is certified that error appears in the above-identified patent and that said Letters Patent are hereby corrected as shown below:

In the specification, Column 7, lines 8 to 19, Table II should appear as follows:

TABLE II

IMPACT STRENGTH AS A FUNCTION OF DESIGN

| Design No. | Product B | Product C | Product D | Product E |
|---|---|---|---|---|
| Fig. 1 | 3.52 ± 0.46 | 1.24 ± 0.21 | 1.81 ± 0.12 | 1.74 ± 0.20 |
| Fig. 2 | 27.61 ± 4.66 | 3.79 ± 1.15 | 4.08 ± 0.90 | 2.05 ± 0.39 |
| Fig. 3 | 4.25 ± 0.44 | 1.45 ± 0.19 | 2.63 ± 0.08 | 1.84 + 0.36 |
| Fig. 4 | 19.68 ± 2.54 | 3.64 ± 0.86 | 4.14 ± 0.72 | 2.51 ± 0.44 |
| Fig. 5-6 | 28.15 ± 6.40 | 10.32 ± 0.88 | 16.11 ± 1.55 | 5.03 ± 0.80 |
| Fig. 7 | 17.42 ± 2.71 | 8.99 ± 1.90 | 12.77 ± 2.12 | 6.13 ± 0.61 |

Signed and Sealed this

Tenth Day of May, 1988

*Attest:*

*Attesting Officer*

DONALD J. QUIGG

*Commissioner of Patents and Trademarks*